US009962580B2

(12) United States Patent
Martino

(10) Patent No.: US 9,962,580 B2
(45) Date of Patent: May 8, 2018

(54) FOOTBALL BODY WITH ANNULARLY DISPOSED AIRFOIL

(71) Applicant: Marc Gregory Martino, Westlake Village, CA (US)

(72) Inventor: Marc Gregory Martino, Westlake Village, CA (US)

( * ) Notice: Subject to any disclaimer, the term of this patent is extended or adjusted under 35 U.S.C. 154(b) by 0 days. days.

(21) Appl. No.: 14/846,772

(22) Filed: Sep. 6, 2015

(65) Prior Publication Data

US 2016/0067556 A1 Mar. 10, 2016

Related U.S. Application Data

(60) Provisional application No. 62/047,017, filed on Sep. 7, 2014.

(51) Int. Cl.
*A63B 43/00* (2006.01)
*A63H 33/18* (2006.01)

(52) U.S. Cl.
CPC ..... *A63B 43/002* (2013.01); *A63H 33/18* (2013.01); *A63B 2209/00* (2013.01); *A63B 2225/01* (2013.01); *A63B 2243/007* (2013.01)

(58) Field of Classification Search
CPC ..... A63B 43/002; A63B 65/00; F01D 9/00
USPC ..... 473/613, 614, 585, 586; 415/137, 139
See application file for complete search history.

(56) References Cited

U.S. PATENT DOCUMENTS 1,410,872 A 3/1922 Baldwin
3,007,410 A 11/1961 Blacker
4,153,223 A 5/1979 Romer
RE33,449 E * 11/1990 Martin ..... A63B 37/12 273/DIG. 20
5,720,651 A * 2/1998 Chien ..... A63B 43/06 415/115
6,048,245 A * 4/2000 Forti ..... A63H 33/18 446/61
6,220,918 B1 * 4/2001 Laronge ..... A63B 65/00 244/3.24
6,454,623 B1 * 9/2002 Flatau ..... A63H 33/185 446/34
6,699,091 B1 3/2004 Warner
6,983,700 B1 1/2006 Malejko
7,300,357 B2 * 11/2007 Breaker ..... A63B 43/002 273/DIG. 20
7,670,204 B2 3/2010 Huber
8,608,598 B2 * 12/2013 Hoang ..... A63H 27/12 446/46
2014/0235380 A1 * 8/2014 Martino ..... A63B 43/002 473/613

* cited by examiner

*Primary Examiner* — Alvin Hunter
*Assistant Examiner* — Rayshun Peng
(74) *Attorney, Agent, or Firm* — Hackler Daghighian Martino & Novak

(57) ABSTRACT

A throwing or catching toy includes a first body defined as having a longitudinal axis. A length of the first body along the longitudinal axis between a front end of the first body to a back end of the first body is longer than an equatorial diameter of the first body. A generally cylindrically-shaped annular second body is disposed about the first body aligned along the longitudinal axis. A connection structure is disposed and connected between the first body and the second body, where the connection structure secures the first body in a fixed position relative to the second body.

20 Claims, 6 Drawing Sheets

FOOTBALL BODY WITH ANNULARLY DISPOSED AIRFOIL

CROSS-REFERENCE TO RELATED APPLICATIONS

This non-provisional patent application claims priority to provisional application 62/047,017 filed on Sep. 7, 2014, the entire contents of which are fully incorporated herein with these references.

DESCRIPTION

Field of the Invention

The present invention generally relates to flying toys. More particularly, the present invention relates to a flying toy that throws and catches like a football but has a more flat trajectory which is achieved by a ring airfoil attached to the football body.

Background of the Invention

It is possible to throw a ring airfoil a long distance. However, throwing such a ring airfoil, especially a large ring airfoil, takes considerable practice to perfect the technique. The throw is a modified throw similar to how a traditional American football is thrown, but requires a different release such that the ring is thrown directly straight while also rotating. Many people have a hard time learning this technique. (It is understood herein that the reference to football means American football which includes sports such as college football and professional football in the United States and does not mean to refer to the game of soccer which is called football outside the United States.)

To make the game of throwing and catching a ring airfoil easier, it is desired that a method or structure be devised that is similar to how a traditional American football is thrown and caught. The present invention fulfills these needs and provides other related advantages.

SUMMARY OF THE INVENTION

An exemplary embodiment of a throwing or catching toy includes a first body defined as having a longitudinal axis, where a length of the first body along the longitudinal axis between a front end of the first body to a back end of the first body is longer than an equatorial diameter of the first body. A generally cylindrically-shaped annular second body is disposed about the first body aligned along the longitudinal axis. Then, a connection structure is disposed and connected between the first body and the second body where the connection structure secures the first body in a fixed position relative to the second body.

In other exemplary embodiments, the first body may define a first center of gravity along the longitudinal axis, and the second body may define a second center of gravity along the longitudinal axis. The first center of gravity may be located at the same place along the longitudinal axis as the second center of gravity. Alternatively, the first center of gravity may be located ahead of the second center of gravity along the longitudinal axis. Alternatively, the first center of gravity may be located behind the second center of gravity along the longitudinal axis.

An overall density of the first body or the second body may be less than 6, 5, 4, 3 or 2 pounds per cubic foot. For example, expanded polypropylene (EPP) is commonly made in densities of 1.3 lbs per cubic foot (lcf) or 1.8/1.9 lcf. Expanded polystyrene (EPS) is also an option and comes in similar densities to the EPP. Either the first or second body could be made as an EPS foam or an EPP foam.

The first body may take many shapes such as missiles, rockets and other fantasy designs but is generally is shaped as a prolate spheroid, an elongated spheroid or as an American football.

The generally cylindrically-shaped annular second body may be shaped as a ring airfoil that is rotationally symmetric about the longitudinal axis to facilitate spinning of the ring airfoil and first body when the toy is thrown by a person. The ring airfoil defines a circumferential leading edge opposite a circumferential trailing edge, where the front end of the first body extends forward beyond the circumferential leading edge of the ring airfoil, and where the back end of the first body extends backward beyond the circumferential trailing edge of the ring airfoil. A cross-section through the ring airfoil aligned with the longitudinal axis may be a symmetrical shaped airfoil cross-section or a non-symmetrical shaped airfoil cross-section. The ring airfoil may be comprised of a thin thickness of polymer, wherein the ring airfoil has a generally convex upper surface opposite a generally concave lower surface, where the upper and lower surfaces define the thin thickness of the ring airfoil.

To reduce drag, the first body may have a cylindrically shaped aperture aligned through the longitudinal axis.

The connection structure may be a plurality of struts symmetrically disposed about longitudinal axis attaching the first and second bodies. The plurality of struts may be rod-shaped or alternatively may be substantially flat sections which can then also be twisted as they extend radially outward to help cut through the air better when thrown spirally.

Overall, a person can throw and catch the first body similar to how a traditional American football is thrown and caught by throwing and spinning both the first and second bodies as one assembly. The overall toy makes for an interesting and exciting new play pattern that adds a dimension of fun to the game of catch.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
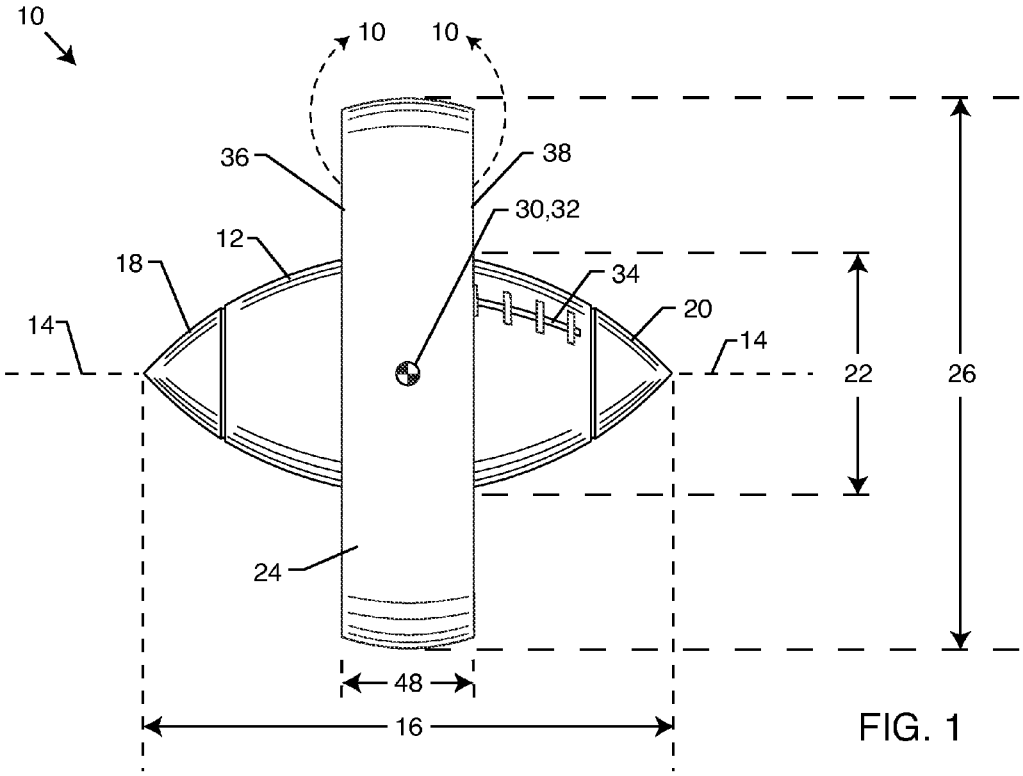
FIG. 1 is a side view of an exemplary flying toy embodying the present invention.

As best seen in FIG. 1, an exemplary embodiment of a throwing or catching toy 10 includes a first body 12 defined as having a longitudinal axis 14. A length 16 of the first body along the longitudinal axis 14 between a front end 18 of the first body to a back end 20 of the first body 12 is longer than an equatorial diameter 22 of the first body 12. A generally cylindrically-shaped annular second body 24 is disposed about the first body 12 aligned along the longitudinal axis 14. The second body 24 has a much larger outer diameter 26 as compared to the equatorial diameter 22 of the first body 12. For example, the equatorial diameter 22 can be about 5 or 4 inches or less whereas the outer diameter 24 may be at least 7, 8 or 9 inches or more. Then, a connection structure 28 (best seen in FIG. 2) is disposed and connected between the first body 12 and the second body 24 where the connection structure 28 secures the first body 12 in a fixed position relative to the second body 24.

Figure 5:
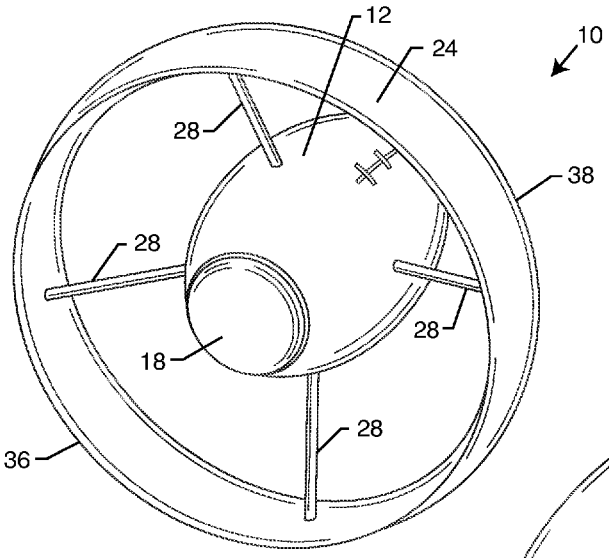
FIG. 5 is a perspective view similar to FIG. 3 now showing the connecting structure as rods or struts and also where the ring airfoil is shifted forward in comparison to the football body.
Figure 6:
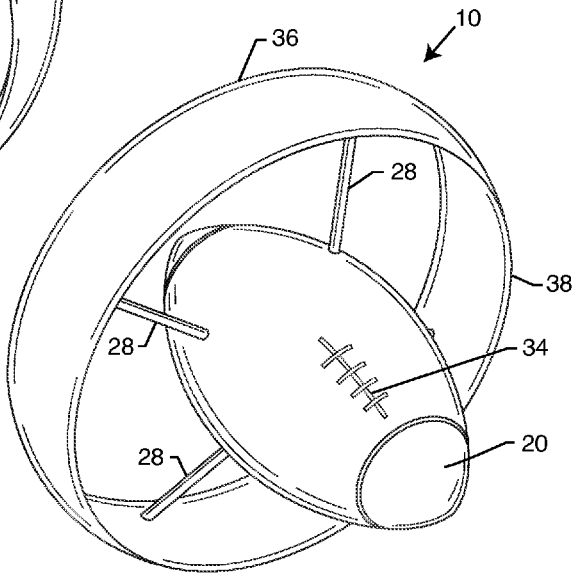
FIG. 6 is a rear perspective view of the structure of FIG. 5.
Figure 7:
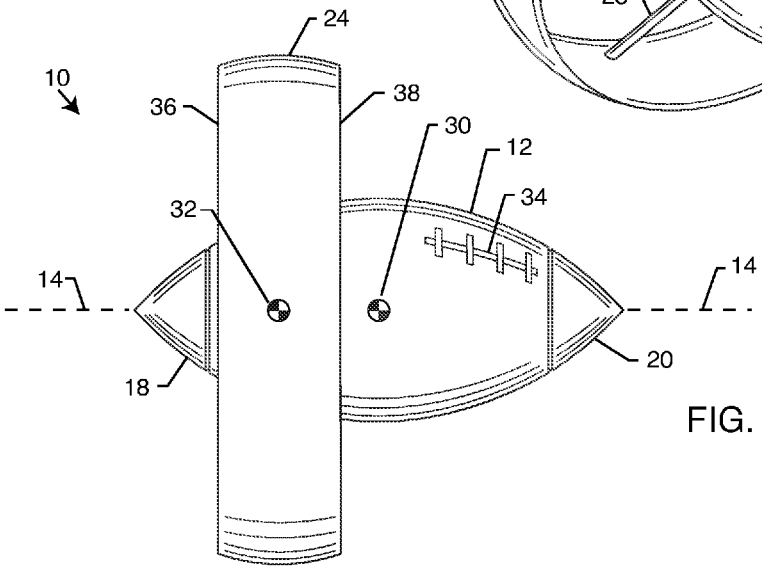
FIG. 7 is a side perspective view of the structure of FIG. 5.

As best seen in FIGS. 1 and 7 the first body 12 may define a first center of gravity 30 along the longitudinal axis 14, and the second body 24 may define a second center of gravity 32 along the longitudinal axis 14. As in FIG. 1, the first center of gravity 30 may be located at the same place along the longitudinal axis 14 as the second center of gravity 30. Alternatively shown in FIG. 5-7, the first center of gravity 30 may be located behind the second center of gravity 32 along the longitudinal axis 14. Not shown but opposite of FIG. 7, the first center of gravity 30 may be located ahead of the second center of gravity 32 along the longitudinal axis 14. Shifting the center of gravities may be a critical aspect for getting the overall balance and overall center of gravity correct for the toy to fly in a straight and reliable direction. Furthermore, the toy 10 can include a method or structure that allows the user to adjust the center of gravities such that the flight characteristics of the toy 10 can be adjusted per each individual user.

It may help the performance of the toy if the overall weight is kept very low, which is well below the weight of a leather football of similar size. Therefore, to achieve such low weights, an overall density of the first body 12 or the second body 24 may be less than 6, 5, 4, 3 or 2 pounds per cubic foot. For example, expanded polypropylene (EPP) is commonly made in densities of 1.3 lbs per cubic foot (lcf) or 1.8/1.9 lcf. Expanded polystyrene (EPS) is also an option and comes in similar densities to the EPP. Either the first or second body could be made as an EPS foam or an EPP foam. Other foams may be used as long as they have a very low density comparable to the EPS and EPP foams.

The first body 12 may take many shapes such as missiles, rockets and other fantasy designs (See FIGS. 11 and 12) but is generally is shaped as a prolate spheroid, an elongated spheroid or as an American football as shown in FIGS. 1-9. To help the user distinguish between the front end 18 of the football body 12 and the back end 20, laces 34 can be integrated to help show the user where to grasp the football body 12. Laces 34 can also be integrated into the fantasy designs shown in FIGS. 11 and 12 again helping the user in utilizing the toy 10.

The generally cylindrically-shaped annular second body 24 may be shaped as a ring airfoil 24 that is rotationally symmetric about the longitudinal axis 14 to facilitate spinning of the ring airfoil 24 and first body 12 when the toy 10 is thrown by a person. The ring airfoil 24 defines a circumferential leading edge 36 opposite a circumferential trailing edge 38, where the front end 28 of the first body 12 extends forward beyond the circumferential leading edge 36 of the ring airfoil 24, and where the back end 20 of the first body 12 extends backward beyond the circumferential trailing edge 38 of the ring airfoil 24. The width 48 of the ring airfoil 24 is less than the length 16 of the first body 12. For example, the width 48 may be about 2-5 inches, or even more than 5 inches, but still less than the length 16 of the first body 12.

Figure 10A:
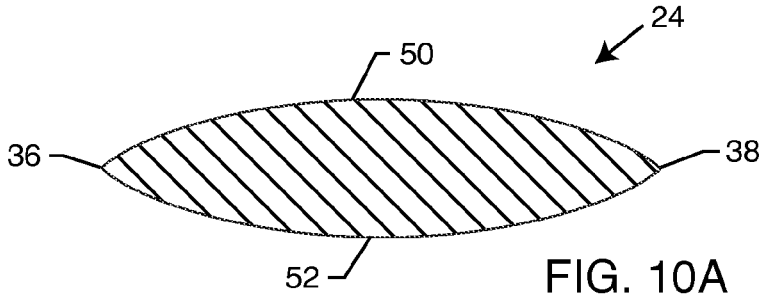
FIG. 10A is one embodiment of an enlarged sectional view taken from the structure of FIG. 1.
Figure 10B:
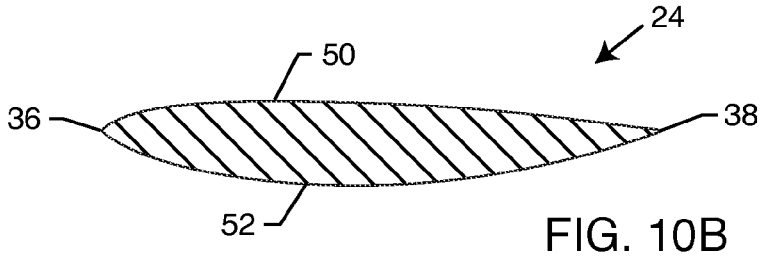
FIG. 10B is another embodiment of an enlarged sectional view taken from the structure of FIG. 1.

FIGS. 10A-10E are enlarged cross-sections taken from FIG. 1 where the cross-section is aligned with the longitudinal axis to best show the shape of the ring airfoil 24. As shown in FIG. 10A, a cross-section through the ring airfoil 24 may be a symmetrical shaped airfoil cross-section. Alternatively as shown in FIG. 10B the ring airfoil 24 may have a non-symmetrical shaped airfoil cross-section. FIG. 10B actually shows the outside surface 50 as being generally flat whereas the inside surface has a more pronounced curvature. This is a typical shape of a wing but upside-down. As can be understood by those skilled in the art, a wide variety of different cross-sections or wing profiles may be used for the ring airfoil 24.

Figure 10C:
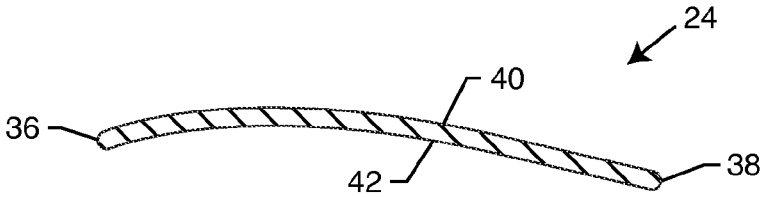
FIG. 10C is another embodiment of an enlarged sectional view taken from the structure of FIG. 1.
Figure 10D:
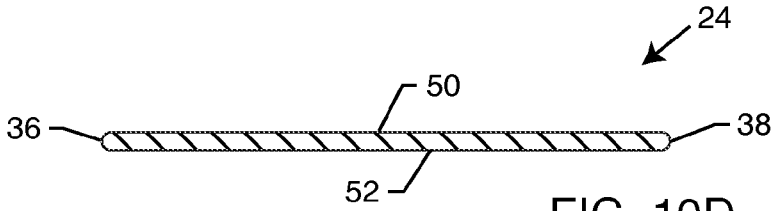
FIG. 10D is another embodiment of an enlarged sectional view taken from the structure of FIG. 1.
Figure 10E:
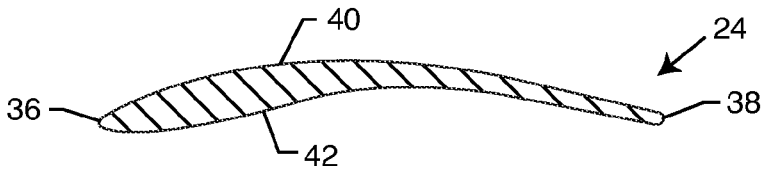
FIG. 10E is another embodiment of an enlarged sectional view taken from the structure of FIG. 1.

Alternatively shown in FIG. 10C, the ring airfoil 24 may be comprised of a thin thickness of polymer, wherein the ring airfoil has a generally convex upper surface 40 opposite a generally concave lower surface 42, where the upper and lower surfaces define the thin thickness of the ring airfoil 24. FIG. 10D shows a flat ring airfoil 24. FIG. 10E is more of a traditional shaped wing which can be made from foam, polymer or a combination thereof. It is possible to have an inner core of foam that has either one or both sides bonded to a thin sheet of polymer. Due to the toy 10 being a football, it will crash into various objects and must be design to absorb some shock loads without breaking. Alternatively, a foam airfoil ring may have a very thin adhesive sticker applied, where the adhesive sticker helps to add strength and stiffness. The sticker could be a durable and weather resistant polymer that can easily absorb stress loads in tension to increase the durability of the ring airfoil.

Figure 9:
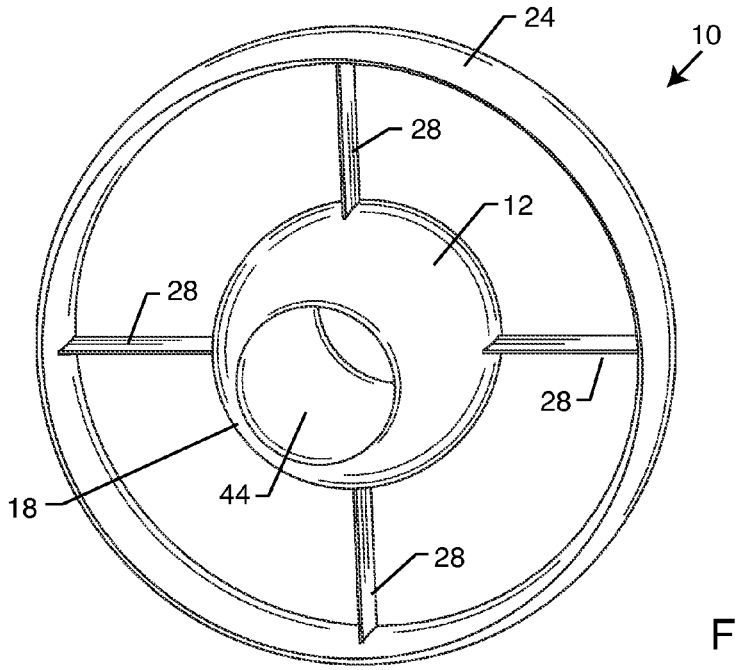
FIG. 9 is a perspective view of a new embodiment of a flying toy where the center has been removed to form a cylindrically shaped aperture to reduce drag.

Reducing drag of the toy 10 as it flies through the air will aid in producing longer throws. As shown in FIG. 9, to reduce drag the first body 12 may have a cylindrically shaped aperture 44 aligned through the longitudinal axis 14.

The connection structure 28 may be a plurality of struts 28 symmetrically disposed about longitudinal axis 14 attaching the first and second bodies. As shown in the drawings herein, each strut 28 is rotated 90 degrees about the longitudinal axis 14 relative to the next adjacent strut 28. This means a total of four struts are used. However, it is understood that two, three, five, six or any other number of struts could be used where they are equally spaced out. For example, the spacing may be 180 degrees, 120 degrees, 60 degrees, 45 degrees and so on.

Figure 2:
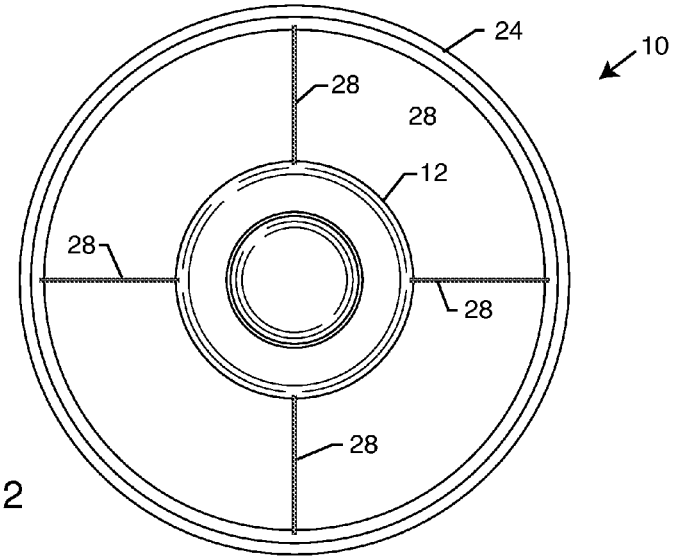
FIG. 2 is a front view of the structure of FIG. 1 now showing the struts.
Figure 3:
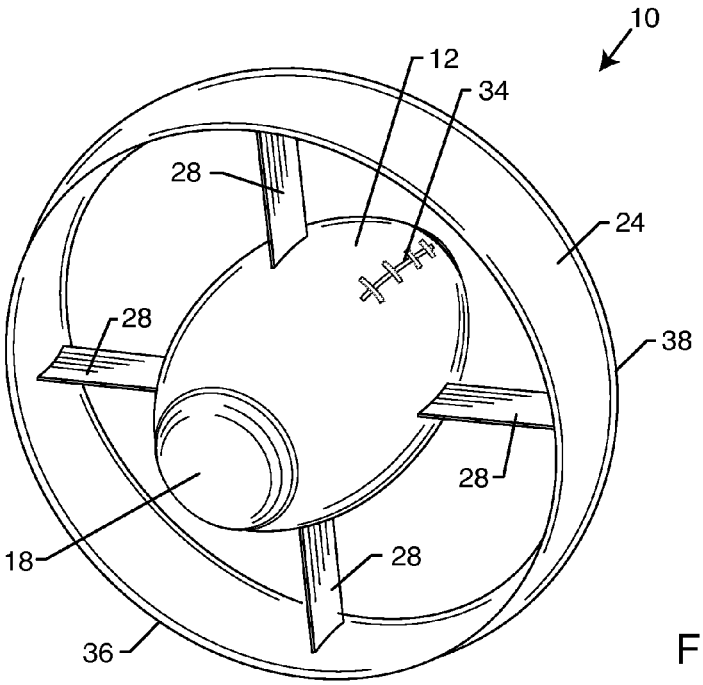
FIG. 3 is a perspective view of the structure of FIGS. 1 and 2.
Figure 4:
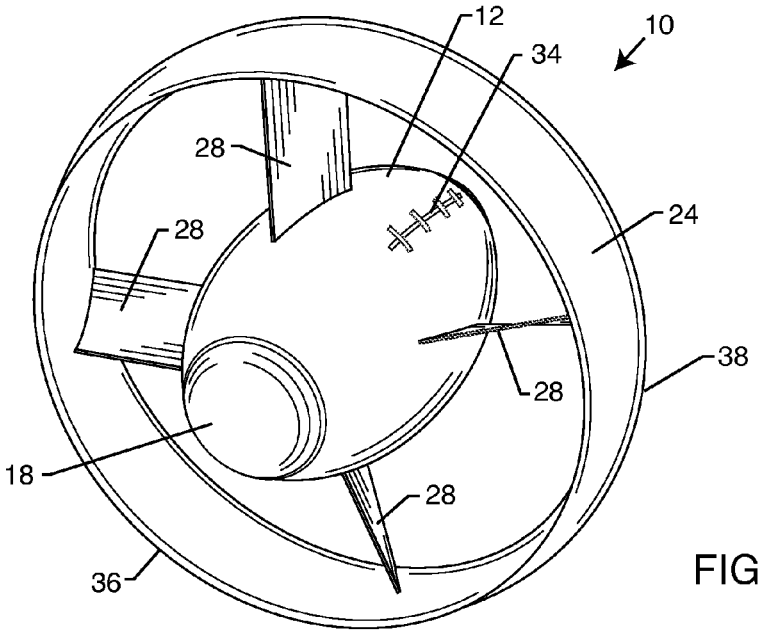
FIG. 4 is a perspective view similar to FIG. 3 now showing the connecting structure as struts that are twisted as they extend radially.

The plurality of struts 28 may be rod-shaped as shown in FIGS. 5-6, 8-9 or alternatively may be substantially flat sections as shown in FIGS. 2-4, which can then also be twisted as shown in FIG. 4 as they extend radially outward to help cut through the air better when thrown spirally. If the flat sections are twisted, this means that the toy is then limited to being either right-handed or left-handed configured. This is because as the product spins, the flat struts will cut thrown the air effectively when spinning one direction, but not the other direction.

Figure 8:
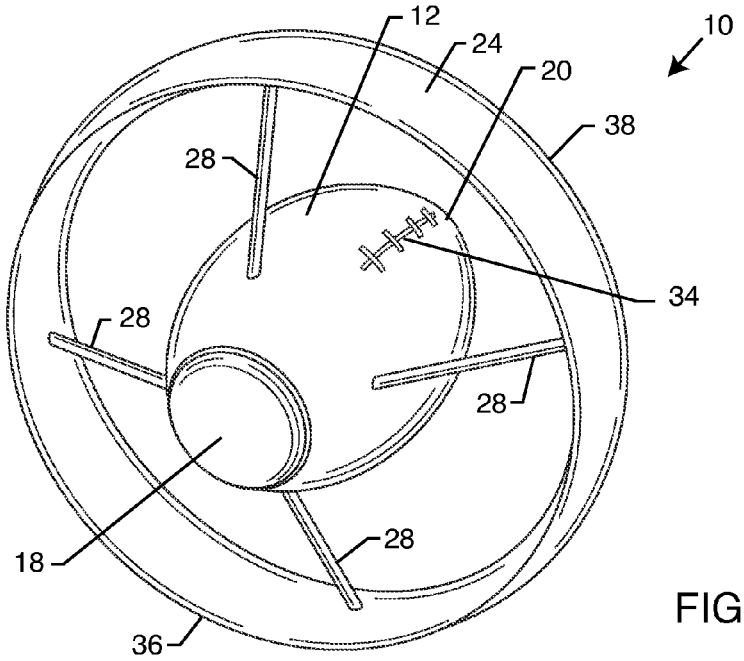
FIG. 8 is a perspective view of a new embodiment of a flying toy where the connecting structure struts are angled forward to reduce drag.

Also shown in FIG. 8 is that the plurality of rods 28 are angled forward to backwards. This is done to also reduce drag as angled struts produce less drag when they cut through the air as compared to perpendicularly positioned struts.

Figure 11:
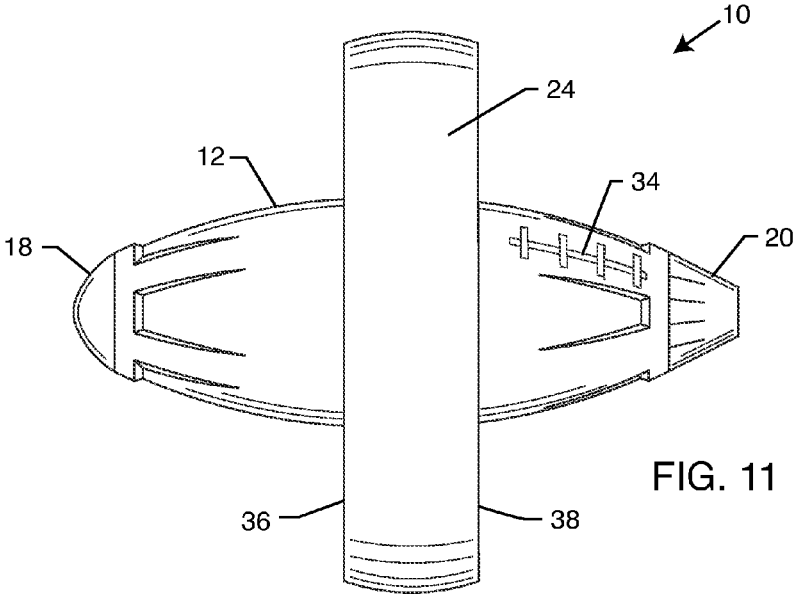
FIG. 11 is a side view of an exemplary embodiment of a flying toy with a futuristic body.
Figure 12:
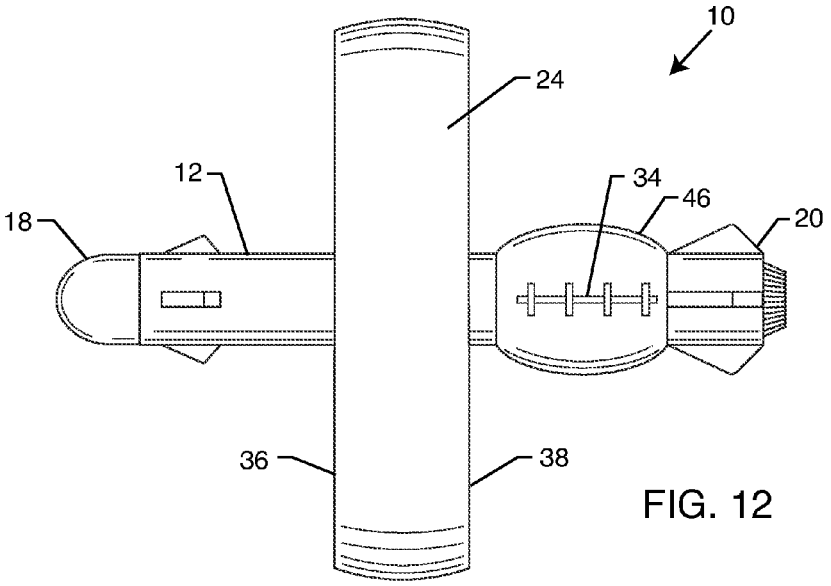
FIG. 12 is a side view of an exemplary embodiment of a flying toy with a futuristic body styled as a missile.

FIG. 11 shows the first body 12 as a futuristic design of a football. FIG. 12 takes the concept even further by styling the first body 12 as a missile. Then a football shaped rear portion 46 is curved and mimics a traditional football body, as this helps the user to understand where to grip and throw the toy 10.

Overall, a person can throw and catch the first body 12 similar to how a traditional American football is thrown and caught by throwing and spinning both the first and second bodies as one assembly. The overall toy 10 makes for an interesting and exciting new play pattern that adds a new dimension of fun to the game of catch.

To help the flight trajectory of the toy 10, the overall weight must be kept low and below one pound, which is about to 453 grams. In other embodiments, the overall weight of the toy 10 can be below 350 grams, 300 grams, 250 grams, 200 grams or even below 150 grams. A lighter overall toy 10 would stay aloft in the air longer as less force by gravity is pulling it downwards.

Although several embodiments have been described in detail for purposes of illustration, various modifications may be made to each without departing from the scope and spirit of the invention. Accordingly, the invention is not to be limited, except as by the appended claims.

NUMERALS

10 toy
12 first body, football
14 longitudinal axis
16 length, first body
18 front end, first body
20 back end, first body
22 equatorial diameter, first body
24 second body, ring airfoil
26 outer diameter, ring airfoil
28 connection structure
30 first center of gravity, first body
32 second center of gravity, second body
34 laces
36 circumferential leading edge
38 circumferential trailing edge
40 convex upper surface
42 concave lower surface
44 cylindrically shaped aperture
46 football shaped rear portion
48 width, ring airfoil
50 outside surface, ring airfoil
52 inside surface, ring airfoil

What is claimed is:

1. A throwing or catching toy, comprising:

a first body defined as having a longitudinal axis, where a length of the first body along the longitudinal axis between a front end of the first body to a back end of the first body is longer than an equatorial diameter of the first body, wherein a maximum diameter of the first body about the longitudinal axis is at least 4 inches and wherein the first body is shaped as a prolate spheroid, an elongated spheroid or as an American football;

a generally cylindrically-shaped annular second body disposed about the first body aligned along the longitudinal axis, the diameter of the second body being 7 inches or more; and a connection structure disposed and connected between the first body and the second body, the connection structure securing the first body in a fixed position relative to the second body;

wherein the front end of the first body extends forward along the longitudinal axis beyond the annular second body, and wherein the back end of the first body extends reward along the longitudinal axis beyond the annular second body;

wherein the toy weighs less than one pound.

2. The toy of claim 1, wherein the first body defines a first center of gravity along the longitudinal axis, and wherein the second body defines a second center of gravity along the longitudinal axis.

3. The toy of claim 2, wherein the first center of gravity is located at the same place along the longitudinal axis as the second center of gravity.

4. The toy of claim 2, wherein a front of the longitudinal axis is disposed along the front end of the first body and a rear of the longitudinal axis is disposed along the back end of the first body, wherein the first center of gravity is located ahead of the second center of gravity along the longitudinal axis.

5. The toy of claim 2, wherein a front of the longitudinal axis is disposed along the front end of the first body and a rear of the longitudinal axis is disposed along the back end of the first body, wherein the first center of gravity is located behind the second center of gravity along the longitudinal axis.

6. The toy of claim 1, wherein an overall density of the first body is less than 3 pounds per cubic foot.

7. The toy of claim 1, wherein an overall density of the second body is less than 3 pounds per cubic foot.

8. The toy of claim 1, wherein the generally cylindrically-shaped annular second body comprises a ring airfoil that is rotationally symmetric about the longitudinal axis to facilitate spinning of the ring airfoil and first body when the toy is thrown by a person.

9. The toy of claim 8, wherein the ring airfoil defines a circumferential leading edge opposite a circumferential trailing edge, where the front end of the first body extends forward beyond the circumferential leading edge of the ring airfoil, and where the back end of the first body extends backward beyond the circumferential trailing edge of the ring airfoil.

10. The toy of claim 8, wherein a cross-section through the ring airfoil aligned with the longitudinal axis is a symmetrical shaped airfoil cross-section.

11. The toy of claim 8, wherein a cross-section through the ring airfoil aligned with the longitudinal axis is a non-symmetrical shaped airfoil cross-section.

12. The toy of claim 8, wherein the ring airfoil is comprised of a thin thickness of polymer, wherein the ring airfoil comprises a generally convex upper surface opposite a generally concave lower surface, where the upper and lower surfaces define the thin thickness of the ring airfoil.

13. The toy of claim 1, wherein the first body comprises a cylindrically shaped aperture aligned through the longitudinal axis.

14. The toy of claim 1, wherein the connection structure comprises a plurality of struts symmetrically disposed about longitudinal axis attaching the first and second bodies.

15. The toy of claim 14, wherein the plurality of struts are rod-shaped.

16. The toy of claim 14, wherein the plurality of struts are substantially flat sections which are twisted as they extend radially outward.

17. The toy of claim 1, wherein either the first or second body comprises an EPS foam or an EPP foam.

18. A throwing or catching toy, comprising:

a first body defined as having a longitudinal axis, where a length of the first body along the longitudinal axis between a front end of the first body to a back end of the first body is longer than an equatorial diameter of the first body, wherein the first body defines a first center of gravity along the longitudinal axis, wherein a maximum diameter of the first body about the longitudinal axis is at least 4 inches and wherein the first body is shaped as an American football;

an annular second body disposed about the first body aligned along the longitudinal axis, wherein the annular second body comprises a ring airfoil that is rotationally symmetric about the longitudinal axis, wherein the second body defines a second center of gravity along the longitudinal axis, and wherein the diameter of the second body is 7 inches or more; and a connection structure disposed and connected between the first body and the second body, the connection structure securing the first body in a fixed position relative to the second body, wherein the connection structure comprises a plurality of struts symmetrically disposed about longitudinal axis attaching the first and second bodies;

wherein a person can throw and catch the first body similar to how a traditional American football is thrown and caught by throwing and spinning both the first and second bodies as one assembly.

19. A throwing or catching toy, comprising:

a first body defined as having a longitudinal axis, where a length of the first body along the longitudinal axis between a front end of the first body to a back end of the first body is longer than an equatorial diameter of the first body, wherein the first body defines a first center of gravity along the longitudinal axis, wherein a maximum diameter of the first body about the longitudinal axis is at least 4 inches and wherein the first body is shaped as an American football;

an annular second body disposed about the first body aligned along the longitudinal axis, wherein the annular second body comprises a ring airfoil that is rotationally symmetric about the longitudinal axis, wherein the ring airfoil defines a circumferential leading edge opposite a circumferential trailing edge, wherein the second body defines a second center of gravity along the longitudinal axis, and wherein the diameter of the second body is 7 inches or more; and a connection structure disposed and connected between the first body and the second body, the connection structure securing the first body in a fixed position relative to the second body, wherein the connection structure comprises a plurality of struts symmetrically disposed about longitudinal axis attaching the first and second bodies;

wherein the front end of the first body extends forward beyond the circumferential leading edge of the ring airfoil, and where the back end of the first body extends backward beyond the circumferential trailing edge of the ring airfoil;

wherein the front end of the first body extends forward along the longitudinal axis beyond the annular second body, and wherein the back end of the first body extends reward along the longitudinal axis beyond the annular second body;

wherein a person can throw and catch the first body similar to how a traditional American football is thrown and caught by throwing and spinning both the first and second bodies as one assembly.

20. The toy of claim 1, wherein the first body does not have outwardly extending fins.

* * * * *